US011132948B2

(12) United States Patent
Park

(10) Patent No.: US 11,132,948 B2
(45) Date of Patent: Sep. 28, 2021

(54) DISPLAY DEVICE AND ELECTRONIC DEVICE HAVING THE SAME

(71) Applicant: Samsung Display Co., Ltd., Yongin-si (KR)

(72) Inventor: Seung Ho Park, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/590,123

(22) Filed: Oct. 1, 2019

(65) Prior Publication Data

US 2020/0135100 A1 Apr. 30, 2020

(30) Foreign Application Priority Data

Oct. 26, 2018 (KR) ..... 10-2018-0129054

(51) Int. Cl.
*G09G 3/30* (2006.01)
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/043* (2013.01); *G09G 2310/08* (2013.01)

(58) Field of Classification Search
CPC ... G09G 2310/0286; G09G 2310/0264; G09G 2310/027; G09G 2310/0272
See application file for complete search history.

(56) References Cited

U.S. PATENT DOCUMENTS 9,773,455 B2 * 9/2017 Chung ..... G09G 3/3225
2015/0235616 A1 * 8/2015 Wu ..... G09G 5/02 345/694
2016/0027377 A1 * 1/2016 Cho ..... H01L 27/3276 315/172
2016/0217731 A1 * 7/2016 Joo ..... G09G 3/3208
2017/0061852 A1 * 3/2017 Byun ..... G09G 3/3275
2018/0357944 A1 * 12/2018 Tang ..... G09G 3/3208

FOREIGN PATENT DOCUMENTS

KR 10-2018-0058282 A 6/2018
KR 10-2018-0060594 A 6/2018

* cited by examiner

*Primary Examiner* — Roy P Rabindranath
(74) *Attorney, Agent, or Firm* — Lewis Roca Rothgerber Christie LLP

(57) ABSTRACT

A display device includes a display panel including a plurality of pixels, a data driver configured to generate a data voltage provided to the pixels, a light stress compensator configured to determine whether a pixel of the pixels satisfies a light stress condition based on an input image data, and to output a data voltage control signal that changes a voltage level of the data voltage provided to the pixel that satisfies the light stress condition, a scan driver configured to generate a scan signal provided to the pixels, and a timing controller configured to generate a control signal that controls the data driver and the scan driver.

18 Claims, 10 Drawing Sheets

| GRAY | CTL_VD |
|---|---|
| 0 | CTL_VD0 |
| 1 | CTL_VD1 |
| 2 | CTL_VD2 |
| 3 | CTL_VD3 |
| ⋮ | ⋮ |
| 10 | CTL_VD10 |

DISPLAY DEVICE AND ELECTRONIC DEVICE HAVING THE SAME

CROSS-REFERENCE TO RELATED APPLICATION

This application claims priority to and the benefit of Korean Patent Application No. 10-2018-0129054, filed on Oct. 26, 2018 in the Korean Intellectual Property Office (KIPO), the content of which is incorporated herein in its entirety by reference.

BACKGROUND

1. Field

Aspects of the present invention relate generally to a display device and an electronic device having the same.

2. Description of the Related Art

Flat panel display (FPD) devices are widely used as display devices of electronic devices because FPD devices are relatively lightweight and thin compared to cathode-ray tube (CRT) display devices. Examples of FPD devices are liquid crystal display (LCD) devices, field emission display (FED) devices, plasma display panel (PDP) devices, and organic light emitting display (OLED) devices. OLED devices have been spotlighted as next-generation display devices because they have various advantages, such as a wide viewing angle, a rapid response speed, low thickness, low power consumption, etc.

Characteristics of the thin film transistor (TFT) included in pixels of the OLED device may be changed by continuous light. When a gate-source voltage of the TFT is smaller than a threshold voltage, the TFT may have a characteristic change more greatly due to the light output from an adjacent pixel. There is a problem that a luminance of the pixel is changed or a static image is generated due to the change in characteristics of the TFT.

The above information disclosed in this Background section is only for enhancement of understanding of the background of the invention and therefore it may contain information that does not form the prior art.

SUMMARY

Aspects of embodiments of the present invention are directed to a display device capable of improving display quality.

Aspects of embodiments of the present invention are directed to an electronic device having the display device capable of improving display quality.

According to some example embodiments, there is provided a display device including: a display panel including a plurality of pixels; a data driver configured to generate a data voltage provided to the pixels; a light stress compensator configured to determine whether a pixel of the pixels satisfies a light stress condition based on an input image data, and to output a data voltage control signal that changes a voltage level of the data voltage provided to the pixel that satisfies the light stress condition; a scan driver configured to generate a scan signal provided to the pixels; and a timing controller configured to generate a control signal that controls the data driver and the scan driver.

In some embodiments, the light stress compensator includes: a light stress determiner configured to determine that the pixel satisfies the light stress condition when at least one of sub-pixels of the pixel emits light and at least one other of the sub-pixels of the pixel emits no light; and a data voltage controller configured to generate the data voltage control signal that changes the voltage level of the data voltage provided to the sub-pixel that emits no light, the sub-pixel being of the pixel that satisfies the light stress condition.

In some embodiments, the light stress determiner is configured to determine that the sub-pixel emits light when the sub-pixel displays light having a grayscale value greater than a first grayscale value, and to determine that the sub-pixel emits no light when the sub-pixel displays light having 0 grayscale value.

In some embodiments, the light stress determiner is configured to determine that the sub-pixel emits light when the sub-pixel displays light having a grayscale value greater than a first grayscale value, and to determine that the sub-pixel emits no light when the sub-pixel displays light having a grayscale value less than a second grayscale value.

In some embodiments, the data voltage controller includes a lookup table (LUT) storing the data voltage control signal corresponding to the grayscale value of the sub-pixel that emits no light.

In some embodiments, the light stress determiner includes a time duration determiner configured to measure a time duration for which the pixel satisfies the light stress condition.

In some embodiments, the data voltage controller is configured to generate the data voltage control signal that changes the voltage level of the data voltage, according to the time duration.

In some embodiments, the data voltage controller is configured to periodically output the data voltage control signal.

In some embodiments, the data voltage controller is configured to non-periodically output the data voltage control signal.

In some embodiments, the data voltage controller is configured to continuously output the data voltage control signal.

In some embodiments, the data voltage controller is configured to non-continuously output the data voltage control signal.

In some embodiments, the light stress compensator includes: a logo detector configured to detect a logo area where a logo is displayed based on the input image data; and a data voltage controller configured to generate the data voltage control signal that changes the voltage level of the data voltage provided to a sub-pixel that emits no light, the sub-pixel being of a pixel of the pixels in the logo area.

In some embodiments, the logo detector is configured to detect a peripheral area that surrounds the logo area, and to change the voltage level of the data voltage provided to the sub-pixel that emits no light, the sub-pixel being of a pixel of the pixels in the logo area or the peripheral area.

According to some example embodiments, there is provided an electronic device includes a display device and a processor that controls the display device, the display device including: a display panel including a plurality of pixels; a data driver configured to generate a data voltage provided to the pixels; a light stress compensator configured to determine whether a pixel of the pixels satisfies a light stress condition based on an input image data, and to output a data voltage control signal that changes a voltage level of the data voltage provided to the pixel that satisfies the light stress condition; a scan driver configured to generate a scan signal provided to the pixels; and a timing controller configured to generate a control signal that controls the data driver and the scan driver.

In some embodiments, the light stress compensator includes: a light stress determiner configured to determine that the pixel satisfies the light stress condition when at least one of sub-pixels of the pixel emits light and at least one other of the sub-pixels of the pixel emits no light; and a data voltage controller configured to generate the data voltage control signal that changes the voltage level of the data voltage provided to the at least one other of the sub-pixels.

In some embodiments, the light stress determiner is configured to determine that the sub-pixel emits light when the sub-pixel displays light having a grayscale value greater than a first grayscale value, and to determine that the sub-pixel emits no light when the sub-pixel displays light having 0 grayscale value.

In some embodiments, the light stress determiner is configured to determine that the sub-pixel emits light when the sub-pixel displays light having a grayscale value greater than a first grayscale value, and to determine that the sub-pixel emits no light when the sub-pixel displays light having a grayscale value less than a second grayscale value.

In some embodiments, the light stress determiner includes a time duration determiner configured to measure a time duration for which the pixel satisfies the light stress condition, and the data voltage controller is configured to generate the data voltage control signal that changes the voltage level of the data voltage as the time duration increases.

In some embodiments, the light stress compensator includes: a logo detector configured to detect a logo area where a logo is displayed based on the input image data; and a data voltage controller configured to generate the data voltage control signal that changes the voltage level of the data voltage provided to a sub-pixel that emits no light, the sub-pixel being of a pixel of the pixels in the logo area.

In some embodiments, the logo detector is configured to detect a peripheral area that surrounds the logo area, and to change the voltage level of the data voltage provided to the sub-pixel that emits no light, the sub-pixel being of a pixel of the pixels in the logo area or the peripheral area.

Therefore, the display device may determine whether the pixel satisfies the light stress condition, and changes the voltage level of the data voltage provided a sub-pixel that emits no light included in the pixel that satisfies the light stress condition, so that a degradation of the driving transistor included in the sub-pixel that emits no light, which may occur due to light stress, may be prevented or substantially reduced. Thus, display quality may improve.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, the present inventive concept will be explained in detail with reference to the accompanying drawings.

Figure 1:
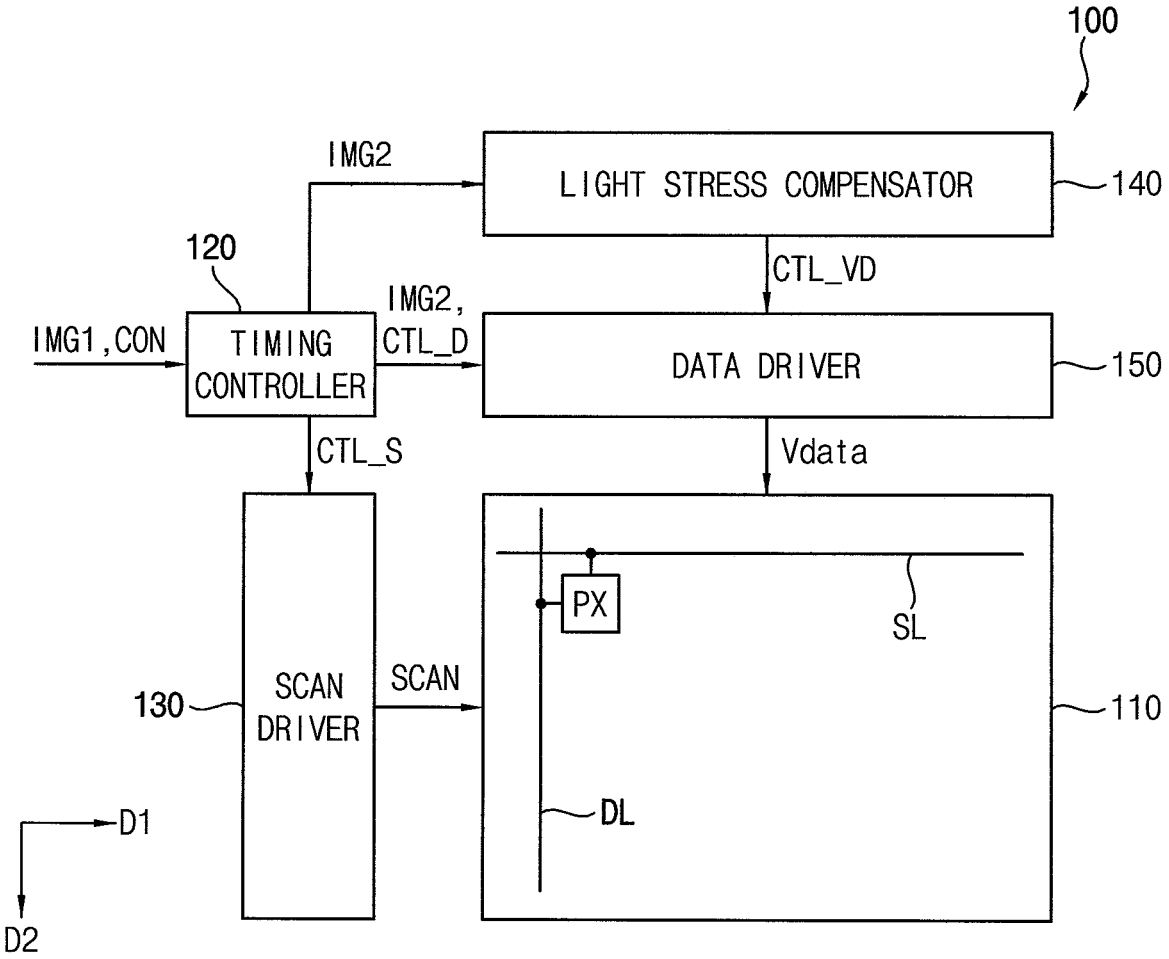
FIG. 1 is a block diagram illustrating a display device according to some example embodiments of the present invention.
Figure 2:
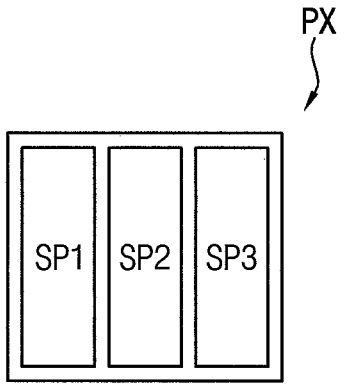
FIG. 2 is a diagram illustrating an example of a pixel of a display panel included in the display device of FIG. 1.

FIG. 1 is a block diagram illustrating a display device according to some example embodiments of the present invention. FIG. 2 is a diagram illustrating an example of a pixel of a display panel included in the display device of FIG. 1.

Referring to FIG. 1, a display device 100 may include a display panel 110, a timing controller 120, a scan driver 130, a light stress compensator 140, and a data driver 150.

The display panel 110 may include a plurality of pixels PX. The display panel 110 may include data lines DL and the scan lines SL. Each of the pixels PX may be respectively coupled to the scan lines SL and the data lines DL. The scan lines SL may extend in a first direction D1 and be arranged in a second direction D2 perpendicular to the first direction D1. The data lines DL may extend in a second direction D2 and be arranged in the first direction D1. The first direction D1 may be parallel with a long side of the display panel 110, and the second direction D2 may be parallel with a short side of the display panel 110. Each of the pixels PX may be formed in intersection regions of the data lines DL and the scan lines.

Referring to FIG. 2, each of the pixels PX may include a first sub-pixel SP1, a second sub-pixel SP2, and a third sub-pixel SP3. For example, the first sub-pixel SP1 may display a red color light, the second sub-pixel SP2 may display a green color light, and the third sub-pixel SP3 may display a blue color light. Although the pixel PX that includes the first sub-pixel SP1, the second sub-pixel SP2, and the third sub-pixel SP3 is described in FIG. 2, the pixel PX is not limited thereto. For example, the pixel PX may further include a fourth sub-pixel that displays a white color light. Each of the sub-pixels may include a driving transistor. The driving transistor may be a thin film transistor (TFT). The driving transistor may be driven by a data voltage Vdata provided to a gate electrode. When a gate-source voltage of the driving transistor is greater than a threshold voltage, the sub-pixel that includes the driving transistor may emit light. When the gate-source voltage of the driving transistor is less than the threshold voltage, the sub-pixel that includes the driving transistor may emit no light. When the gate-source voltage of the driving transistor is less than the threshold voltage, characteristic of the driving transistor may be changed by light emit from a peripheral sub-pixel. The display device 100 according to example embodiments may determine whether the pixel PX satisfies a light stress condition based on an input image data, and changes a voltage level of the data voltage Vdata provided to the sub-pixel that emits no light included in the pixel PX that satisfies the light stress condition. Thus, the degradation of the driving transistor may be prevented or substantially reduced. Hereinafter, the display device 100 will be described in detail.

The timing controller 120 may convert a first image data IMG1 provided from an external device to a second image data IMG2 and generate a data control signal CTL_D and a scan control signal CTL_S that control a driving of the second image data IMG2. The timing controller 120 may convert the first image data IMG1 to the second image data IMG2 by performing an image enhancement algorithm (e.g., a dynamic capacitance compensation (DCC)). When the timing controller 120 does not include the image enhancement algorithm, the first image data IMG1 may output as the second image data IMG2. The timing controller may provide the second image data IMG2 to the light stress compensator 140 and the data driver 150. The timing controller 120 may receive a control signal CON from the external device and generate the data control signal CTL_D provided to the data driver 150 and generate the scan control signal CTL_S provided to the scan driver 130. For example, the data control signal CTL_D may include a horizontal start signal and at least one clock signal. For example, the scan control signal CTL_S may include a vertical start signal and at least one clock signal.

The scan driver 130 may provide a scan signal SCAN to the pixels through the scan lines SL. The scan driver 130 may generate the scan signal SCAN based on the scan control signal CTL_S provided from the timing controller 120. The scan driver 130 may provide the scan signal SCAN to the pixels PX in the display panel 110 through the scan lines SL.

In some example embodiments, the light stress compensator 140 may determine whether the pixel PX satisfies the light stress condition based on the second image data IMG2 and generate a data voltage control signal CTL_VD that changes the voltage level of the data voltage Vdata provided to the pixel PX that satisfies the light stress condition. The light stress compensator 140 may determine whether the pixel PX satisfies the light stress condition based on the second image data IMG2 provided from the timing controller 120. The light stress compensator 140 may determine that the pixel PX satisfies the light stress condition when at least one of the sub-pixels included in the pixel PX emits light and at least one other of the sub-pixels in the pixel PX emits no light. For example, the light stress compensator 140 may determine that the pixel PX satisfies the light stress condition when the third sub-pixel SP3 that displays the blue color light emits light and the first sub-pixel SP1 that displays the red color light and the second sub-pixel SP2 that displays the green color light emit no light. In some example embodiments, the light stress compensator 140 may determine that the sub-pixel emits light when the sub-pixel displays light having a grayscale value greater than a first grayscale value (e.g., a set or predetermined first grayscale value), and determine that the sub-pixel emits no light when the sub-pixel displays light having 0 grayscale value. For example, when the display device 100 is driven in 8-bit mode, the first grayscale value may have the 100 grayscale value. The light having the 0 grayscale value may be black color light. That is, the light stress compensator 140 may determine that the pixel PX satisfies the light stress condition when the pixel includes at least one sub-pixel that displays light having greater than the 100 grayscale value and at least one sub-pixel that displays light having the 0 grayscale value. In other example embodiments, the light stress compensator 140 may determine that the sub-pixel emits light when the sub-pixel displays light having a grayscale value greater than a first grayscale value (e.g., a set or predetermined first grayscale value), and determine that the sub-pixel emits no light when the sub-pixels displays light having a grayscale value less than a second grayscale value (e.g., a set or predetermined second grayscale value). For example, when the display device 100 is driven in 8-bit mode, the first grayscale value may have the 100 grayscale value and the second grayscale value may have the 10 grayscale value. That is, the light stress compensator 140 may determine that the pixel PX satisfies the light stress condition when the pixel includes at least one sub-pixel that displays light having greater than the 100 grayscale value and at least one sub-pixel that displays light having less than the 10 grayscale value.

The light stress compensator 140 may generate the data voltage control signal CTL_VD that changes the voltage level of the data voltage Vdata provided to the non-light emitting sub-pixel (i.e., the sub-pixel that emits no light) included in the pixels PX that satisfies the light stress condition. For example, the data voltage control signal CTL_VD may be a signal that increases the voltage level of the data voltage Vdata provided to the non-light emitting sub-pixel. For example, when the third sub-pixel SP3 emits light and the first sub-pixel SP1 and second sub-pixel SP2 emit no light, the light stress compensator may generate the data voltage control signal CTL_VD that changes the voltage level of the data voltage provided to the first sub-pixel SP1 and the second sub-pixel SP2. Here, the data voltage control signal CTL_VD provided to the first sub-pixel SP1 and the data voltage control signal CTL_VD provided to the second sub-pixel SP2 may be different from each other because a rate of characteristic change of the driving transistor of the first sub-pixel SP1 and a rate of characteristic change of the driving transistor of the second sub-pixel SP2 are different from each other. The data voltage control signal CTL_VD may be provided to the data driver 150.

In other example embodiments, the light stress compensator 140 may detect a logo area where a logo is displayed based on the second image data IMG2 and generate the data voltage control signal CTL_VD that changes the voltage level of the data voltage Vdata provided to the non-light emitting sub-pixel (i.e., the sub-pixel that emits no light) included in the logo area. The driving transistors included in the pixels PX in the logo area may be rapidly degraded because the pixels PX in the logo area continuously emit light. The light stress compensator 140 may detect the logo area while the display device 100 is driven. That is, the light stress compensator 140 may determine that the pixels PX included in the logo area satisfies the light stress condition. The light stress compensator 140 may generate the data voltage control signal CTL_VD that changes the voltage level of the data voltage Vdata provided to the non-light emitting sub-pixel included in the pixels in the logo area.

Further, the light stress compensator 140 may detect the logo area and a peripheral area that surrounds the logo area based on the second image data IMG2. The light stress compensator 140 may generate the data voltage control signal CTL_VD that changes the voltage level of the data voltage Vdata provided to the non-light emitting sub-pixel of the pixels PX included in the logo area and the peripheral area. Here, the light stress compensator 140 may generate the data voltage control signal CTL_VD that changes the voltage level of the non-light emitting sub-pixel of the pixels PX included in the peripheral area different from the voltage level of the non-light emitting sub-pixel of the pixels PX included in the logo area. For example, the light stress compensator 140 may generate a first voltage control signal that changes the voltage level of the data voltage Vdata provided to the non-light emitting sub-pixel of the pixels PX in the logo area to a first voltage level and generate a second data voltage control signal that changes the voltage level of the data voltage Vdata provided to the non-light emitting sub-pixel of the pixels PX in the peripheral area to a second voltage level less than the first voltage level. Thus, a boundary of the logo area may not be recognized (e.g., may not be recognizable to a user).

The data driver 150 may generate the data voltage Vdata based on the second image data IMG2 and the data voltage control signal CTL_VD. The data driver 150 may generate grayscale voltage corresponding to the second image data IMG2 as the data voltage Vdata. The data driver 150 may change the voltage level of the data voltage Vdata provided to the non-light emitting sub-pixel included in the pixels PX that satisfy the light stress condition based on the data voltage control signal CTL_VD. For example, the data driver 150 may increase the voltage level of the data voltage Vdata provided to the non-light emitting sub-pixel that displays the 0 grayscale value based on the data voltage control signal CTL_VD. When the voltage level of the data voltage Vdata increases, luminance of the sub-pixel may increase and affect display quality, so that the amount of increase of the data voltage Vdata may be derived experimentally and set in advance. The data driver 150 may provide the data voltage Vdata to the pixels PX in the display panel 110 through the data line DL. Thus, the gate-source voltage greater than the threshold voltage of the driving transistor of the non-light emitting sub-pixel included in the pixels PX that satisfy the light stress condition may be applied, so that the characteristics of the driving transistor may not be changed.

Although the light stress compensator 140 coupled to the timing controller 120 and the data driver 150 is described in FIG. 1, the light stress compensator 140 may not be limited thereto. For example, the light stress compensator 140 may be located in the timing controller 120 or in the data driver 150.

As described above, the display device 100 of FIG. 1 may determine whether the pixel PX satisfies the light stress condition and change the voltage level of the data voltage Vdata provided to the non-light emitting sub-pixel included in the pixel PX that satisfies the light stress condition, so that the degradation of the driving transistor due to the light stress may be prevented or substantially reduced.

Figure 3:
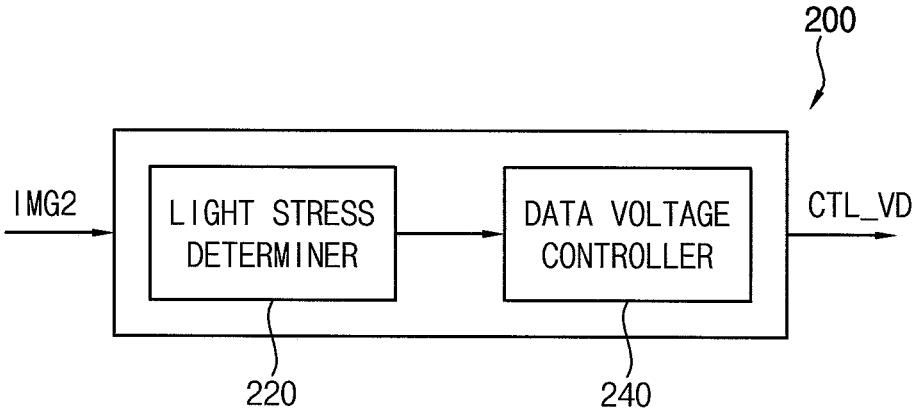
FIG. 3 is a block diagram illustrating an example of a light stress compensator included in the display device of FIG. 1.
Figure 4A:
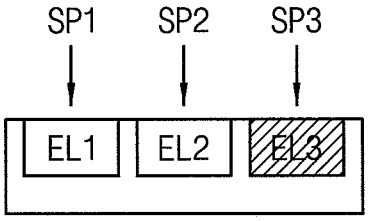
FIGS. 4A-4B are diagrams illustrating examples of a pixel of a display panel included in the display device of FIG. 1.
Figure 4B:
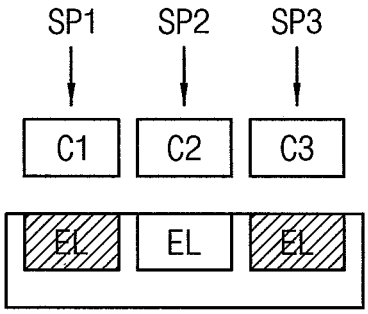
Figures 5, 6:
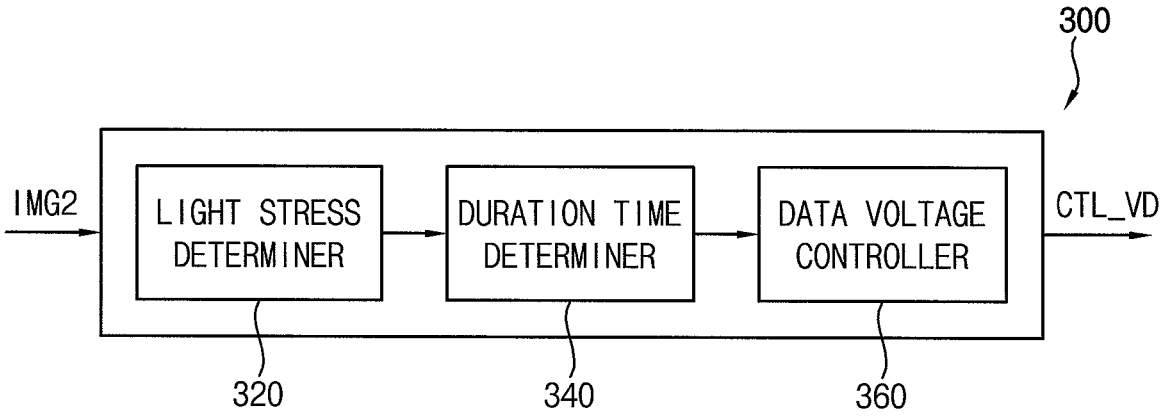
FIG. 5 is a table illustrating an example of a lookup table included in a data voltage controller of the light stress compensator of FIG. 3.
FIG. 6 is a block diagram illustrating other example of a light stress compensator included in the display device of FIG. 1.

FIG. 3 is a block diagram illustrating an example of a light stress compensator included in the display device of FIG. 1. FIGS. 4A and 4B are diagrams illustrating examples of a pixel of a display panel included in the display device of FIG. 1. FIG. 5 is a table illustrating an example of a lookup table included in a data voltage controller of the light stress compensator of FIG. 3.

Referring to FIG. 3, a light stress compensator 200 may include a light stress determiner 220 and a data voltage controller 240. The light stress compensator 200 of FIG. 3 may correspond to the light stress compensator 140 of FIG. 1.

The light stress determiner 220 may determine that the pixel satisfies the light stress condition based on the second image data IMG2 when at least one of sub-pixels included in the pixel emits light and at least one other of sub-pixels included in the pixel emits no light. In some example embodiments, the light stress determiner 220 may determine that the sub-pixel emits light when the sub-pixel displays the light having a grayscale value greater than the first grayscale value and determine that the sub-pixel emits no light when the sub-pixel displays light having the 0 grayscale value. In other example embodiments, the light stress determiner 220 may determine that the sub-pixel emits light when the sub-pixel displays the light having a grayscale value greater than the first grayscale value and determine that the sub-pixel emits no light when the sub-pixel displays light having a grayscale value less than the second grayscale value.

Referring to FIG. 4A, the pixel of the display panel may include the first sub-pixel SP1, the second sub-pixel SP2, and the third sub-pixel SP3. For example, the first sub-pixel SP1 may display the red color light by including a red color organic light emitting layer EL1, the second sub-pixel SP2 may display the green color light by including a green color organic light emitting layer EL2, and the third sub-pixel SP3 may display the blue color light by including a blue color organic light emitting layer EL3. The light stress determiner 220 may determine that the pixel satisfies the light stress condition when at least one of the first sub-pixel SP1, the second sub-pixel SP2, and the third sub-pixel SP3 emits light and at least one other of the first sub-pixel SP1, the second sub-pixel SP2, and the third sub-pixel SP3 emits no light. For example, the light stress determiner 220 may determine that the pixel satisfies the light stress condition when the third sub-pixel SP3 emits light and the first sub-pixel SP1 and the second sub-pixel SP2 emit no light.

Referring to FIG. 4B, the pixel of the display panel may include the first sub-pixel SP1, the second sub-pixel SP2, and the third sub-pixel SP3. For example, the first sub-pixel SP1 may display the red color light by including a white color organic light emitting layer EL and a red color filter C1, the second sub-pixel SP2 may display the green color light by including a white color organic light emitting layer EL and a green color filter C2, and the third sub-pixel SP3 may display the blue color light by including a white color organic light emitting layer EL and a blue color filter C3. The light stress determiner 220 may determine that the pixel satisfies the light stress condition when at least one of the first sub-pixel SP1, the second sub-pixel SP2, and the third sub-pixel SP3 emits light and at least one other of the first sub-pixel SP1, the second sub-pixel SP2, and the third sub-pixel SP3 emits no light. For example, the light stress determiner 220 may determine that the pixel satisfies the light stress condition when the first sub-pixel SP1 and the third sub-pixel SP3 emit light and the second sub-pixel SP2 emits no light.

The data voltage controller 240 may generate the data voltage control signal CTL_VD that changes the voltage level of the data voltage provided to the non-light emitting sub-pixel included in the pixel that satisfies the light stress condition. For example, the data voltage control signal CTL_VD may be the signal that increases the voltage level of the data voltage provided to the non-light emitting sub-pixel. For example, when the third sub-pixel SP3 emits light and the first sub-pixel SP1 and the second sub-pixel SP2 emits no light, the data voltage generator may generate the data voltage control signal CTL_VD that increases the voltage level of the data voltage provided to the first sub-pixel SP1 and the data voltage control signal CTL_VD that increases the voltage level of the data voltage provided to the second sub-pixel SP2. Here, the data voltage control signal CTL_VD that changes the voltage level of the data voltage provided to the first sub-pixel SP1 and the data voltage control signal CTL_VD that changes the voltage level of the data voltage provided to the second sub-pixel SP2 may be different from each other. For example, the data voltage controller 240 may generate the data voltage control signal CTL_VD that increases the voltage level of the data voltage provided to the first sub-pixel SP1 to about 0.3 V and generate the data voltage control signal CTL_VD that increase the voltage level of the data voltage provided to the second sub-pixel SP2 to about 0.2 V.

In some example embodiments, when the light stress determiner 220 determines that the sub-pixel that displays the light having 0 grayscale value is the non-light emitting sub-pixel, the data voltage controller 240 may generate the data voltage control signal CTL_VD that increases the voltage level of the data voltage provided to the sub-pixel that displays the light having 0 grayscale value. The data voltage controller 240 may generate the data voltage control signals CTL_VD corresponding to each of the first sub-pixel SP1, the second sub-pixel SP2, and the third sub-pixel SP3.

In other example embodiments, when the light stress determiner 220 determines that the sub-pixel that displays the light having the grayscale value less than or equal to the second grayscale value, the data voltage controller may include a lookup table (LUT) that stores the data voltage control signals CTL_VD corresponding to grayscale values less than the second grayscale value. For example, referring to FIG. 5A, when the second grayscale value has 10 grayscale value, the data voltage controller 240 may store 0th to 10th data voltage control signals CTL_VD0 to CTL_VD10 corresponding to the 0 grayscale value to the 10 grayscale value, respectively. The data voltage controller 240 may output the data voltage control signal CTL_VD corresponding to the grayscale value of the non-light sub-pixel based on the lookup table. For example, when the non-light emitting sub-pixel displays the light having the 0 grayscale value, the data voltage controller 240 may output the 0th data voltage control signal CTL_VD0. When the non-light emitting sub-pixel displays the light having the 10 grayscale value, the data voltage controller 240 may output the 10th data voltage control signal CTL_VD10. The data voltage controller 240 may include lookup tables that store the data voltage control signal CTL_VD corresponding to each of the grayscale values of the first sub-pixel SP1, the second sub-pixel SP2, and the third sub-pixel SP3. The data driver 150 may change the voltage of the data voltage based on the data voltage control signal CTL_VD.

Figure 7:
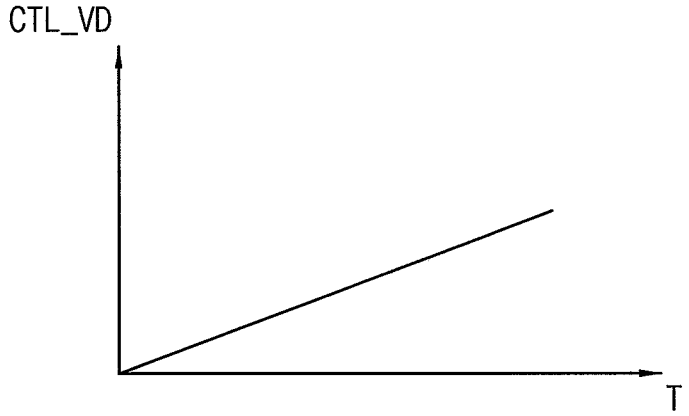
FIG. 7 is a diagram illustrating an operation of a data voltage controller included in the light stress compensator of FIG. 6.

FIG. 6 is a block diagram illustrating another example of a light stress compensator included in the display device of FIG. 1. FIG. 7 is a diagram illustrating an operation of a data voltage controller included in the light stress compensator of FIG. 6.

Referring to FIG. 6, a light stress compensator 300 may include a light stress determiner 320, a time duration determiner 340, and the data voltage controller 360. The light stress compensator 300 of FIG. 6 may correspond to the light stress compensator 140 of FIG. 1.

The light stress determiner 320 may determine that the pixel satisfies the light stress condition based on the second image data IMG2 when at least one of sub-pixels included in the pixel emits light and at least one other of sub-pixels included in the pixel emits no light. The light stress determiner 320 of FIG. 6 may be substantially the same as or similar to the light stress compensator 200 of FIG. 3.

The time duration determiner 340 may measure a time duration that the pixel satisfies the light stress condition. For example, the time duration determiner 340 may measure the time duration by counting clock signals (e.g., counting pulses of a clock signal) provided at regular time intervals. The characteristic change of the driving transistor included in the non-light emitting sub-pixel may decrease as the time duration that the pixel satisfies the light stress condition increases. That is, the threshold voltage of the driving transistor may decrease and the luminance of the non-light emitting sub-pixel may increase as the time duration increases.

The data voltage controller 360 may generate the data voltage control signal CTL_VD that changes the voltage level of the data voltage according to the time duration. The data driver 150 may generate the data voltage based on the data voltage control signal CTL_VD. For example, the data driver 150 may change the voltage level of the data voltage by adding the data voltage control signal CTL_VD to the data voltage. Referring to FIG. 7, the data voltage controller 360 may generate the data voltage control signal CTL_VD that increases the voltage level of the data voltage as the time duration T increases. The luminance decrease due to the degradation of the driving transistor may be prevented or substantially reduced by increasing the voltage level of the data voltage because the threshold voltage of the driving transistor decreases and the characteristic of the driving transistor included in the non-light emitting sub-pixel is changes as the time duration T increase.

FIGS. 8A through 8E are diagrams illustrating an operation of a data voltage controller included in the light stress compensator of FIG. 6.

The data voltage controller 360 may generate the data voltage control signal CTL_VD that changes the voltage level of the data voltage. For example, the data driver 150 may change the voltage level of the data voltage by adding the data voltage control signal CTL_VD to the data voltage.

Figure 8A:
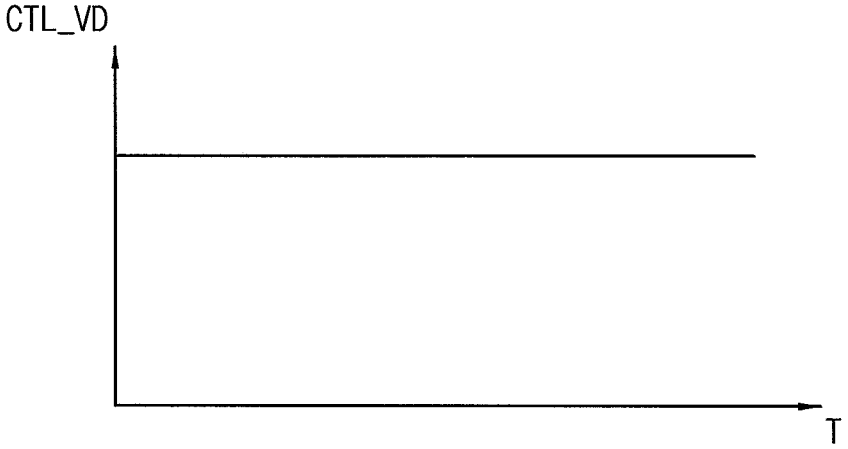
FIGS. 8A-8E are diagrams illustrating an operation of a data voltage controller included in the light stress compensator of FIG. 6.
Figure 8B:
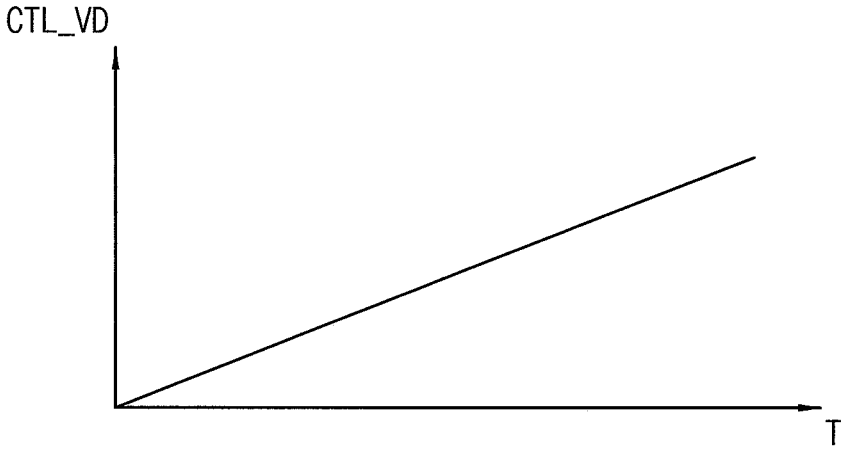

Referring to FIGS. 8A and 8B, the data voltage controller 360 may continuously output the data voltage control signal CTL_VD. Referring to FIG. 8A, the data voltage controller 360 may continuously output the data voltage control signal CTL_VD having a constant level. Referring to FIG. 8B, the data voltage controller 360 may output the data voltage control signal CTL_VD that increases as the time T passes.

Figure 8C:
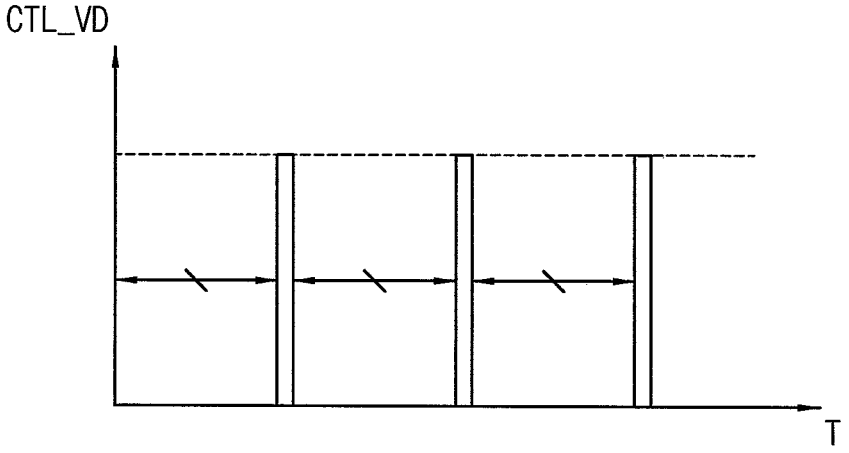
Figure 8D:
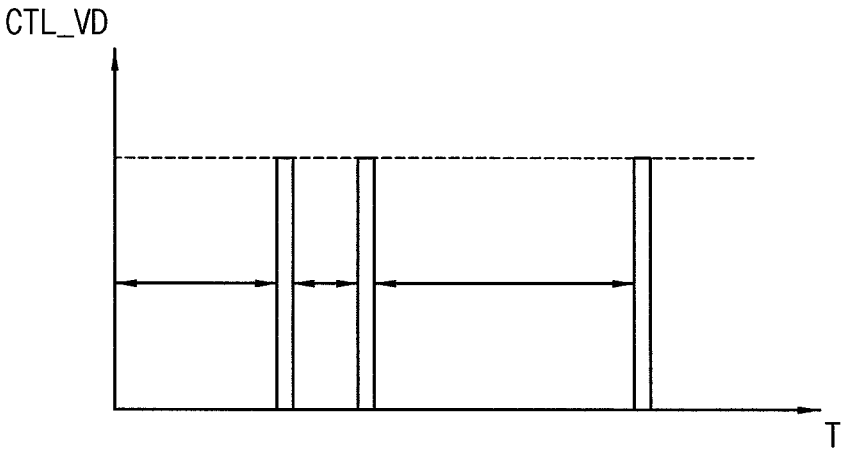

Referring to FIGS. 8C and 8D, the data voltage controller 360 may discontinuously output the data voltage control signal CTL_VD. Referring to FIG. 8C, the data voltage controller 360 may periodically output the data voltage control signal CTL_VD. Referring to FIG. 8D, the data voltage controller 360 may non-periodically output the data voltage control signal CTL_VD.

Figure 8E:
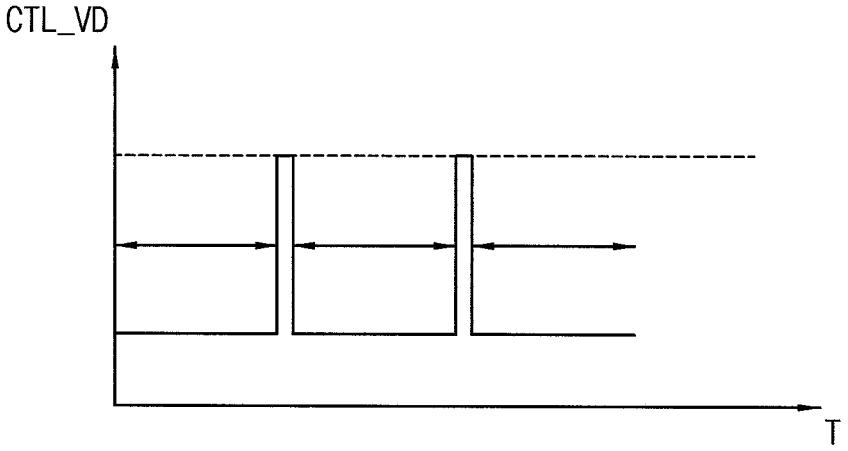

Referring to FIG. 8E, the data voltage controller 360 may periodically change and output the data voltage control signal CTL_VD.

Figure 9:
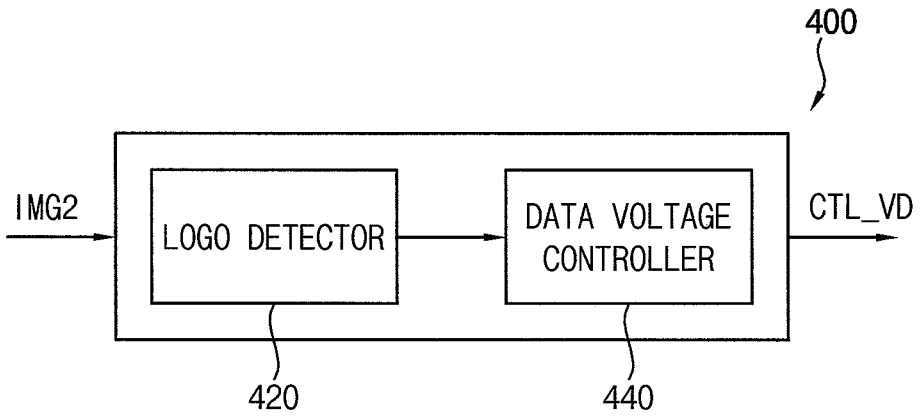
FIG. 9 is a block diagram illustrating another example of a light stress compensator included in the display device of FIG. 1.
Figure 10:
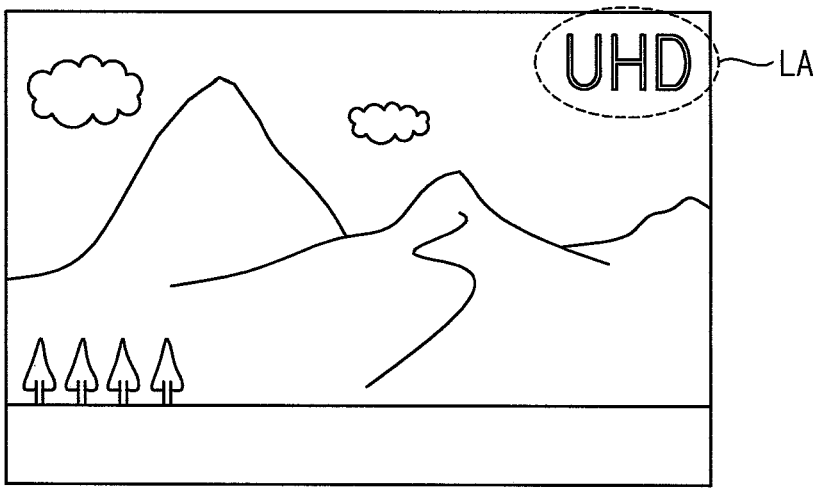
FIG. 10 is a diagram illustrating an example of an image displayed on a display panel included in the display device of FIG. 1.
Figure 11A:
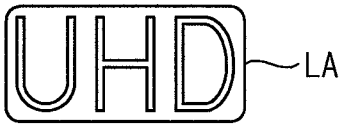
FIGS. 11A-11B are diagrams illustrating an example of an operation of the light stress compensator of FIG. 9.
Figure 11B:
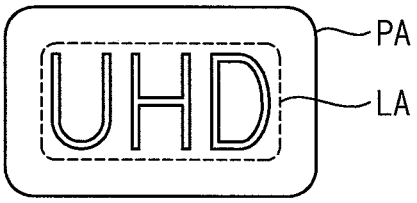

FIG. 9 is a block diagram illustrating another example of a light stress compensator included in the display device of FIG. 1. FIG. 10 is a diagram illustrating an example of an image displayed on a display panel included in the display device of FIG. 1. FIGS. 11A and 11B are diagrams illustrating an example of an operation of the light stress compensator of FIG. 9.

Referring to FIG. 9, a light stress compensator 400 may include a logo detector 420 and a data voltage controller 440. The light stress compensator 400 of FIG. 9 may correspond to the light stress compensator 140 of FIG. 1. Referring to FIG. 10, when a broadcasting image is displayed on the display panel, a logo of a broadcasting company may be continuously displayed on the upper right or upper left of the display panel. While the logo is being displayed, some of the sub-pixels in the logo area may continue to emit light and some of the other sub-pixels in the logo area may continue to emit no light. In this case, the characteristic of the driving transistor included in the sub-pixel that emits no light may be changed due to the light that emits from the sub-pixel that emits light. That is, the pixels in the logo area may satisfy the light stress condition.

Referring to FIG. 11A, the logo detector 420 may detect the logo area LA on which the logo is displayed based on the second image data IMG2. The logo area LA may include the pixels that include the sub-pixel that emits light and the sub-pixel that emits no light.

The data voltage controller 440 may generate the data voltage control signal CTL_VD that changes the voltage level of the data voltage provided to the non-light emitting sub-pixel (i.e., the sub-pixel that emits no light) of the pixel in the logo area LA. For example, the data voltage control signal CTL_VD may be the signal that increases the voltage level of the data voltage provided to the non-light emitting sub-pixel.

Referring to FIG. 11B, the logo detector 420 may detect the logo area LA on which the logo is displayed and the peripheral area PA that surrounds the logo area LA based on the second image data IMG2. The pixels in the logo area LA and the peripheral area PA may include the sub-pixel that emits light and the sub-pixel that emits no light.

The data voltage controller 440 may generate the data voltage control signal CTL_VD that changes the voltage level of the data voltage provided to the non-light emitting sub-pixel of the pixel included in the logo area LA and the peripheral area PA. For example, the data voltage control signal CTL_VD may be the signal that increases the voltage level of the data voltage provided to the non-light emitting sub-pixel. The data voltage controller 440 may respectively generate the data voltage control signals CTL_VD provided to each of the non-light emitting sub-pixel in the logo area LA and the non-light emitting sub-pixel in the peripheral area PA. For example, the light stress compensator 400 may generate the data voltage control signal CTL_VD, which changes the voltage level of the data voltage provided to the non-light emitting sub-pixel of the pixel in the logo area LA, to the first voltage level, and may generate the data voltage control signal CTL_VD, which changes the voltage level of the data voltage provided to the non-light emitting sub-pixel of the pixel in the peripheral area PA, to the second voltage level. Thus, the boundary of the logo area LA may not be recognized (e.g., may not be recognizable to a user).

Figure 12:
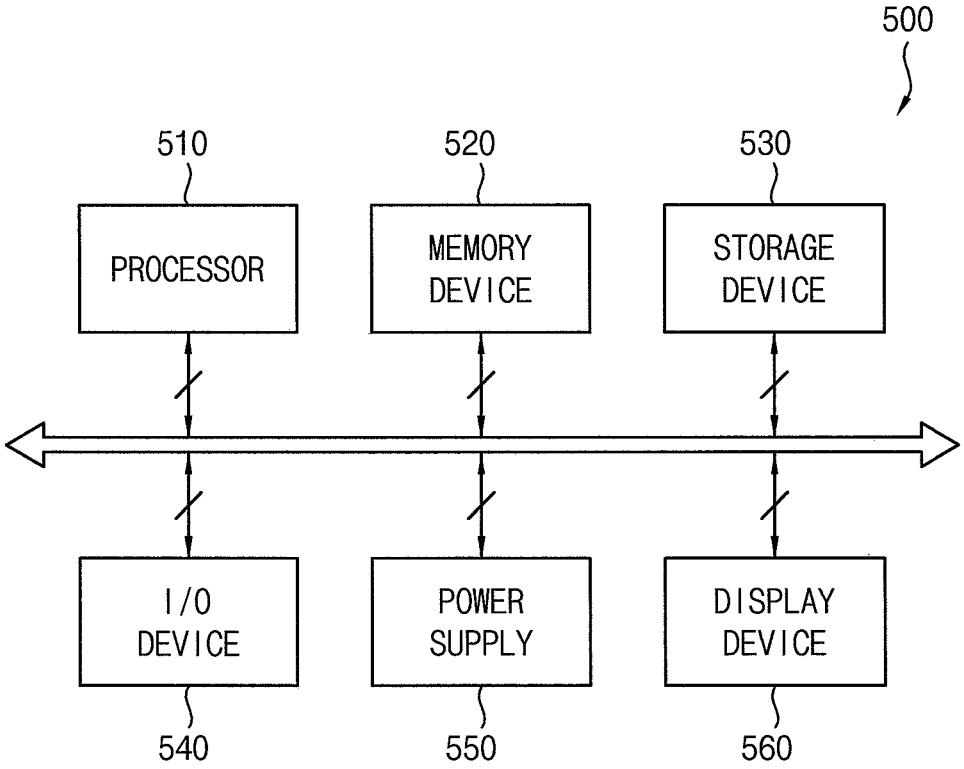
FIG. 12 is a block diagram illustrating an electronic device according to some example embodiments.
Figure 13:
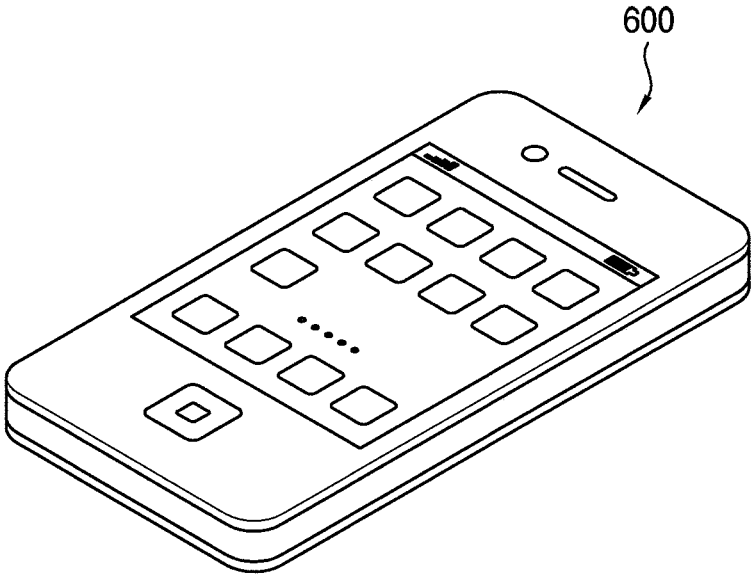
FIG. 13 is a diagram illustrating an example embodiment in which the electronic device of FIG. 12 is implemented as a smart phone.

FIG. 12 is a block diagram illustrating an electronic device according to example embodiments. FIG. 13 is a diagram illustrating an example embodiment in which the electronic device of FIG. 12 is implemented as a smart phone.

Referring to FIGS. 12 and 13, an electronic device 500 may include a processor 510, a memory device 520, a storage device 530, an input/output (I/O) device 540, a power device 550, and a display device 560. Here, the display device 560 may correspond to the display device 100 of FIG. 1. In addition, the electronic device 500 may further include a plurality of ports for communicating a video card, a sound card, a memory card, a universal serial bus (USB) device, other electronic device, etc. Although it is illustrated in FIG. 13 that the electronic device 500 is implemented as a smart phone 600, the type/kind of the electronic device 500 is not limited thereto.

The processor 510 may perform various computing functions. The processor 510 may be a microprocessor, a central processing unit (CPU), etc. The processor 510 may be coupled to other components via an address bus, a control bus, a data bus, etc. Further, the processor 510 may be coupled to an extended bus such as a component interconnect (PCI) bus. The memory device 520 may store data for operations of the electronic device 500. For example, the memory device 520 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 530 may be a solid stage drive (SSD) device, a hard disk drive (HDD) device, a CD-ROM device, etc.

The I/O device 540 may include an input device such as a keyboard, a keypad, a touchpad, a touch-screen, a mouse, etc, and an output device such as a printer, a speaker, etc. In some example embodiments, the display device 560 may be included in the I/O device 540. The power device 550 may provide power for the operations of the electronic device 500. The display device 560 may communicate with other components via the buses and/or other communication links. As described above, the display device 560 may include a display panel, a timing controller, a scan driver, a light stress compensator, and a data driver.

The display panel may include a plurality of pixels and each of the pixels may include sub-pixels. The timing controller may convert a first image data provided from the external device to a second image data, and generate a data control signal and a scan control signal that control a driving of the second image data. The scan driver may provide scan signal to the pixels through scan lines. The light stress compensator may determine whether the pixel satisfies the light stress condition based on the second image data and generate a data voltage control signal that changes a voltage level of a data voltage provided to the pixel that satisfies the light stress condition. In some example embodiments, the light stress compensator may determine that the pixel satisfies the light stress condition when at least one of the sub-pixels included in the pixel emits light and at least one other of the sub-pixels in the pixel emits no light. In other example embodiments, the light stress compensator may determine that the pixel included in the logo area satisfies the light stress condition. The light stress compensator may generate the data voltage control signal that changes the voltage level of the data voltage provided to a non-light emitting sub-pixel (i.e., the sub-pixel that emits no light) of the pixel that satisfies the light stress condition. For example, the data voltage control signal may be a signal that increases the voltage level of the data voltage provided to the non-light emitting sub-pixel. The data driver may generate the data voltage based on the second image data and the data voltage control signal. The data driver may generate a grayscale voltage corresponding to the second image data as the data voltage. The data driver may change the voltage level of the data voltage provided to the non-light emitting sub-pixel included in the pixels that satisfies the light stress condition. The data driver may provide the data voltage to the pixels in the display panel. Thus, a gate-source voltage greater than a threshold voltage of a driving transistor may be provided to the non-light emitting sub-pixel included in the pixel that satisfies the light stress condition so that characteristic of the driving transistor may not be changed.

As described above, the electronic device 500 of FIG. 12 may include the display device 560 that determine whether the pixel satisfies the light stress condition and changes the voltage level of the data voltage provided to the non-light emitting sub-pixel included in the pixel that satisfies the light stress condition so that a degradation of the driving transistor due to light stress may be prevented or substantially reduced.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ.

Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of example embodiments of the present invention and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as being limited to the specific example embodiments disclosed, and that modifications to the disclosed example embodiments, as well as other example embodiments, are intended to be included within the scope of the present invention as defined by the appended claims and equivalents thereof.

What is claimed is:

1. A display device comprising:

a display panel comprising a plurality of pixels;

a data driver configured to generate a data voltage provided to the pixels;

a light stress compensator configured to determine whether a pixel of the pixels satisfies a light stress condition based on an input image data, and to output a data voltage control signal that changes a voltage level of the data voltage provided to the pixel that satisfies the light stress condition, the light stress compensator comprising:

a light stress determiner configured to determine that the pixel satisfies the light stress condition when at least one of sub-pixels of the pixel emits light and at least one other of the sub-pixels of the pixel emits no light, to determine that the sub-pixel emits light when the sub-pixel displays light having a grayscale value greater than a first grayscale value, and to determine that the sub-pixel emits no light when the sub-pixel displays light having a grayscale value less than a second grayscale value;

a scan driver configured to generate a scan signal provided to the pixels; and a timing controller configured to generate a control signal that controls the data driver and the scan driver.

2. The display device of claim 1, wherein the light stress compensator further comprises:

a data voltage controller configured to generate the data voltage control signal that changes the voltage level of the data voltage provided to the sub-pixel that emits no light, the sub-pixel being of the pixel that satisfies the light stress condition.

3. The display device of claim 2, wherein the light stress determiner is configured to determine that the sub-pixel emits light when the sub-pixel displays light having a grayscale value greater than a first grayscale value, and to determine that the sub-pixel emits no light when the sub-pixel displays light having 0 grayscale value.

4. The display device of claim 2, wherein the data voltage controller comprises a lookup table (LUT) storing the data voltage control signal corresponding to the grayscale value of the sub-pixel that emits no light.

5. The display device of claim 2, wherein the light stress determiner comprises a time duration determiner configured to measure a time duration for which the pixel satisfies the light stress condition.

6. The display device of claim 5, wherein the data voltage controller is configured to generate the data voltage control signal that changes the voltage level of the data voltage, according to the time duration.

7. The display device of claim 2, wherein the data voltage controller is configured to periodically output the data voltage control signal.

8. The display device of claim 2, wherein the data voltage controller is configured to non-periodically output the data voltage control signal.

9. The display device of claim 2, wherein the data voltage controller is configured to continuously output the data voltage control signal.

10. The display device of claim 2, wherein the data voltage controller is configured to non-continuously output the data voltage control signal.

11. A display device comprising:

a display panel comprising a plurality of pixels;

a data driver configured to generate a data voltage provided to the pixels;

a light stress compensator configured to determine whether a pixel of the pixels satisfies a light stress condition based on an input image data, and to output a data voltage control signal that changes a voltage level of the data voltage provided to the pixel that satisfies the light stress condition;

a scan driver configured to generate a scan signal provided to the pixels; and a timing controller configured to generate a control signal that controls the data driver and the scan driver, wherein the light stress compensator comprises:

a logo detector configured to detect a logo area where a logo is displayed based on the input image data; and a data voltage controller configured to generate the data voltage control signal that changes the voltage level of the data voltage provided to a sub-pixel that emits no light, the sub-pixel being of a pixel of the pixels in the logo area.

12. The display device of claim 11, wherein the logo detector is configured to detect a peripheral area that surrounds the logo area, and to change the voltage level of the data voltage provided to the sub-pixel that emits no light, the sub-pixel being of a pixel of the pixels in the logo area or the peripheral area.

13. An electronic device comprises a display device and a processor that controls the display device, the display device comprising:

a display panel comprising a plurality of pixels;

a data driver configured to generate a data voltage provided to the pixels;

a light stress compensator configured to determine whether a pixel of the pixels satisfies a light stress condition based on an input image data, and to output a data voltage control signal that changes a voltage level of the data voltage provided to the pixel that satisfies the light stress condition, the light stress compensator comprising:

a light stress determiner configured to determine that the pixel satisfies the light stress condition when at least one of sub-pixels of the pixel emits light and at least one other of the sub-pixels of the pixel emits no light, to determine that the sub-pixel emits light when the sub-pixel displays light having a grayscale value greater than a first grayscale value, and to determine that the sub-pixel emits no light when the sub-pixel displays light having a grayscale value less than a second grayscale value;

a scan driver configured to generate a scan signal provided to the pixels; and a timing controller configured to generate a control signal that controls the data driver and the scan driver.

14. The electronic device of claim 13, wherein the light stress compensator further comprises:

a data voltage controller configured to generate the data voltage control signal that changes the voltage level of the data voltage provided to the at least one other of the sub-pixels.

15. The electronic device of claim 14, wherein the light stress determiner is configured to determine that the sub-pixel emits light when the sub-pixel displays light having a grayscale value greater than a first grayscale value, and to determine that the sub-pixel emits no light when the sub-pixel displays light having 0 grayscale value.

16. The electronic device of claim 14, wherein the light stress determiner comprises a time duration determiner configured to measure a time duration for which the pixel satisfies the light stress condition, and wherein the data voltage controller is configured to generate the data voltage control signal that changes the voltage level of the data voltage as the time duration increases.

17. The electronic device of claim 13, wherein the light stress compensator comprises:

a logo detector configured to detect a logo area where a logo is displayed based on the input image data; and a data voltage controller configured to generate the data voltage control signal that changes the voltage level of the data voltage provided to a sub-pixel that emits no light, the sub-pixel being of a pixel of the pixels in the logo area.

18. The electronic device of claim 17, wherein the logo detector is configured to detect a peripheral area that surrounds the logo area, and to change the voltage level of the data voltage provided to the sub-pixel that emits no light, the sub-pixel being of a pixel of the pixels in the logo area or the peripheral area.

* * * * *